US011114012B2

(12) United States Patent
Huang

(10) Patent No.: US 11,114,012 B2
(45) Date of Patent: Sep. 7, 2021

(54) DISPLAY PANEL DRIVING CIRCUIT AND DISPLAY DEVICE

(71) Applicant: HKC CORPORATION LIMITED, Guangdong (CN)

(72) Inventor: Xiaoyu Huang, Guangdong (CN)

(73) Assignee: HKC CORPORATION LIMITED, Shenzhen (CN)

( * ) Notice: Subject to any disclaimer, the term of this patent is extended or adjusted under 35 U.S.C. 154(b) by 0 days.

(21) Appl. No.: 17/060,281

(22) Filed: Oct. 1, 2020

(65) Prior Publication Data

US 2021/0020092 A1 Jan. 21, 2021

Related U.S. Application Data

(63) Continuation of application No. PCT/CN2019/073132, filed on Jan. 25, 2019.

(30) Foreign Application Priority Data

Dec. 27, 2018 (CN) ..... 201811617081.4

(51) Int. Cl.
*G09G 3/20* (2006.01)

(52) U.S. Cl.
CPC ..... *G09G 3/20* (2013.01); *G09G 2310/0267* (2013.01); *G09G 2310/0275* (2013.01); *G09G 2310/08* (2013.01)

(58) Field of Classification Search
CPC ..... G09G 3/20; G09G 2310/0267; G09G 2310/0275; G09G 2310/08;
(Continued)

(56) References Cited

U.S. PATENT DOCUMENTS

2015/0130824 A1* 5/2015 Lee ..... G09G 3/20 345/534
2017/0076662 A1* 3/2017 Ishii ..... G09G 3/3275
(Continued)

FOREIGN PATENT DOCUMENTS

CN 101539900 A 9/2009
CN 104217695 A 12/2014
(Continued)

OTHER PUBLICATIONS

First Chinese Office Action Application No. 201811617081.4; dated Feb. 25, 2020.
(Continued)

*Primary Examiner* — Andrew Sasinowski

(57) ABSTRACT

The present discloses provides a display panel driving circuit and a display device. The display panel driving circuit includes a memory; a control chip; and a timing controller including data transmission ends and a control end, the data transmission ends are connected with a control signal output end of a communication switching circuit and a data output end of the memory, and the control end is connected with a controlled end of the communication switching circuit. The timing controller is configured to receive a control signal output by the control chip when controlling the communication switching circuit to be turned on and to read software data of the memory when controlling the communication switching circuit to be turned off.

20 Claims, 2 Drawing Sheets

(58) Field of Classification Search
CPC ..... G09G 2370/08; G09G 2370/04; G09G 2370/042; G09G 2370/06; G09G 5/006
See application file for complete search history.

(56) References Cited

U.S. PATENT DOCUMENTS

| | | | | |
|---|---|---|---|---|
| 2018/0183899 | A1* | 6/2018 | Ansari | H04N 21/8547 |
| 2018/0308416 | A1* | 10/2018 | Chen | G06T 1/60 |
| 2020/0184921 | A1* | 6/2020 | Yong | G06F 1/266 |

FOREIGN PATENT DOCUMENTS

| | | | |
|---|---|---|---|
| CN | 104599653 | A | 5/2015 |
| CN | 206270872 | U | 6/2017 |
| CN | 207039796 | U | 2/2018 |

OTHER PUBLICATIONS

Second Chinese Office Action Application No. 201811617081.4; dated Oct. 10, 2020.
International Search Report dated Sep. 17, 2019; PCT/CN2019/073132.
Written Opinion dated Sep. 17, 2019; PCT/CN2019/073132.

* cited by examiner

DISPLAY PANEL DRIVING CIRCUIT AND DISPLAY DEVICE

CROSS REFERENCE TO RELATED APPLICATIONS

The present disclosure is a Continuation Application of PCT Application No. PCT/CN2019/073132, filed on Jan. 25, 2019, which claims the priority of Chinese Patent Application with No. 201811617081.4, entitled "DISPLAY PANEL DRIVING CIRCUIT AND DISPLAY DEVICE", filed on Dec. 27, 2018, which is hereby incorporated by reference in its entirety.

TECHNICAL FIELD

The present disclosure relates to the technical field of display driving, in particular to a display panel driving circuit and a display device.

BACKGROUND

The statements herein only provide background information related to the present disclosure and do not necessarily constitute a prior Art.

In a display device, generally, data stored in a Static Read Only Memory (SROM) inside a Timing Controller Integrated Circuit (TCON IC) cannot be stored any longer after a power failure, whereas data stored in an Electrically Erasable Programmable Read Only Memory (EEPROM) or a Flash can be stored even after a power failure, therefore, a control program of a timing controller is stored in an external EEPROM or Flash. After power-up, the timing controller starts initialization and reads the timing control data from the external memory through a bus. The timing controller is then connected with a control chip through the bus.

Since both the memory and the timing controller are connected with the timing controller through the communication bus, a control signal of the control chip may interfere with the data reading between the timing controller and the memory when reading the timing control data from the external memory through the bus, resulting in a data reading failure.

SUMMARY

The main purpose of the present disclosure is to provide a display panel driving circuit and a display device, aiming at solving the problem of software reading errors of a timing controller and improving the reliability of the display device.

To achieve the purpose above, the present disclosure provides a display panel driving circuit, and the display panel driving circuit includes:

a memory;

a control chip, connected to a serial communication bus;

a communication switching circuit, including a controlled end, a control signal input end and a control signal output end, the control signal input end is in communication with the control chip through the serial communication bus; and a timing controller, including data transmission ends and a control end, the data transmission ends is connected with the control signal output end of the communication switching circuit and a data output end of the memory, and the control end is connected with the controlled end of the communication switching circuit;

the timing controller is configured to receive a control signal output by the control chip when controlling the communication switching circuit to be turned on and to read software data of the memory when controlling the communication switching circuit to be turned off.

Optionally, the display device further includes a communication isolation circuit, the communication isolation circuit is arranged in series between the communication switching circuit and the timing controller, and the communication isolation circuit is configured to isolate and then output the control signal output by the control chip when the timing controller controls the communication switching circuit to be turned on.

Optionally, the communication isolation circuit includes a first unidirectional conduction element and a second unidirectional conduction element, an input end of the first unidirectional conduction element is connected with an output end of a first gating branch, and an output end of the first unidirectional conduction element is connected with the data transmission end of the timing controller; and an input end of the second unidirectional conduction element is connected with an output end of a second gating branch, and an output end of the second unidirectional conduction element is connected with the data transmission end of the timing controller.

Optionally, the serial communication bus includes a data line and a clock line, the communication switching circuit includes a first gating branch, a second gating branch and a D flip-flop, a clock signal input end of the D flip-flop is connected with the control end of the timing controller, a data input end of the D flip-flop is connected with a first DC power supply, a data output end of the D flip-flop is connected with a controlled end of the first gating branch and a controlled end of the second gating branch, the first gating branch is arranged in series between the data line and one data transmission end of the timing controller, and the second gating branch is arranged in series between the clock line and the other data transmission end of the timing controller.

Optionally, the first gating branch includes a first electronic switch and a first resistor, a controlled end of the first electronic switch is the controlled end of the first gating branch and is grounded through the first resistor, an input end of the first electronic switch is connected with the data line, and an output end of the first electronic switch is connected with the second data transmission end of the timing controller.

Optionally, the second gating branch includes a second electronic switch and a second resistor, a controlled end of the second electronic switch is the controlled end of the second gating branch and is grounded through the second resistor, an input end of the second electronic switch is connected with the data line, and an output end of the second electronic switch is connected with the data transmission end of the timing controller.

Optionally, the display panel driving circuit further includes a third unidirectional conduction element, an input end of the third unidirectional conduction element is connected with the memory, and an output end of the third unidirectional conduction element is connected with the timing controller.

Optionally, the display panel driving circuit further includes a gate driving circuit and a source driving circuit, and a controlled end of the gate driving circuit and a controlled end of the source driving circuit are both connected with an output end of the timing controller.

The present disclosure further provides a display panel driving circuit, which includes:

a memory;

a plurality of control chips, connected to a serial communication bus;

a communication switching circuit, including a controlled end, a control signal input end and a control signal output end, the control signal input end is in communication with the control chips through the serial communication bus;

a unidirectional conduction element, an input end of the unidirectional conduction element is connected with the control signal output end of the communication switching circuit; and a timing controller, including data transmission ends and a control end, the data transmission ends is connected with an output end of the unidirectional conduction element and a data output end of the memory, and the control end is connected with the controlled end of the communication switching circuit;

the timing controller is configured to receive a control signal output by the control chip when controlling the communication switching circuit to be turned on and to read software data of the memory when controlling the communication switching circuit to be turned off.

The present disclosure further provides a display device, which includes a display panel and the display panel driving circuit as described above, a gate driving circuit and a source driving circuit of the display panel are both electrically connected with the display panel.

According to the present disclosure, the control chip, the timing controller and the memory are arranged, communication is enabled through the serial communication bus, the communication switching circuit is arranged in series between the control chip and the timing controller, the communication switching circuit is controlled by a timing control circuit, the communication between the timing controller and the memory is realized when the timing controller controls the communication switching circuit to be turned off, so that the timing controller reads the software data of the memory, and then the initial setting of the timing controller is completed. When the timing controller controls the communication switching circuit to be turned on, the communication between the timing controller and the control chip is realized, so that the control signal output by the control chip is received, converted into a corresponding driving signal and then output to complete the image display of the display panel. The present disclosure solves the problem that when the timing controller reads the data of the memory, the data of the memory may run into the control chip, resulting in work disorder of the control chip, or the data signal of the control chip is output to the timing controller or the memory, causing the timing controller to fail to read the data of the memory. The present disclosure effectively solves the problem of software reading errors of the timing controller and improves the reliability of the display device.

BRIEF DESCRIPTION OF THE DRAWINGS

In order to illustrate the technical schemes in the embodiments of the present disclosure or in the prior art more clearly, the drawings which are required to be used in the description of the embodiments or the prior art are briefly described below. It is obvious that the drawings described below are only some embodiments of the present disclosure. It is apparent to those of ordinary skill in the art that other drawings may be obtained based on the structures shown in accompanying drawings without inventive effort.

With reference to the drawings, the implement of the object, features and advantages of the present disclosure will be further illustrated in conjunction with embodiments.

DETAILED DESCRIPTION OF THE EMBODIMENTS

The technical solutions in the embodiments of the present disclosure will be clearly and completely described hereafter in reference to the drawings in the embodiments of the present disclosure. It is apparent that the described embodiments are merely a part of embodiments rather than all the embodiments of the present disclosure. All the other embodiments obtained by the artisans concerned on the basis of the embodiments in the present disclosure without creative efforts fall within the scope of claims of the present disclosure.

It is to be understood that, all of the directional instructions in the exemplary embodiments of the present disclosure (such as top, down, left, right, front, back . . . ) can only be used for explaining relative position relations, moving condition of the elements under a special form (referring to figures), and so on, if the special form changes, the directional instructions changes accordingly.

In addition, the descriptions, such as the "first", the "second" in the present disclosure, are only used for descriptive purpose, and cannot be understood as indicating or suggesting relative importance or impliedly indicating the number of the indicated technical features. Therefore, the character indicated by the "first", the "second" can explicitly or implicitly include at least one feature. Additionally, the technical solution of each embodiment can be combined with each other on the condition that it can be realized by ordinary artisans concerned; if the combination of technical solution contradicts each other or cannot be realized, it should be regarded that the combination of such solution does not exist, nor is it in the protection scope required by the present disclosure.

The present disclosure provides a display panel driving circuit.

Figure 1:
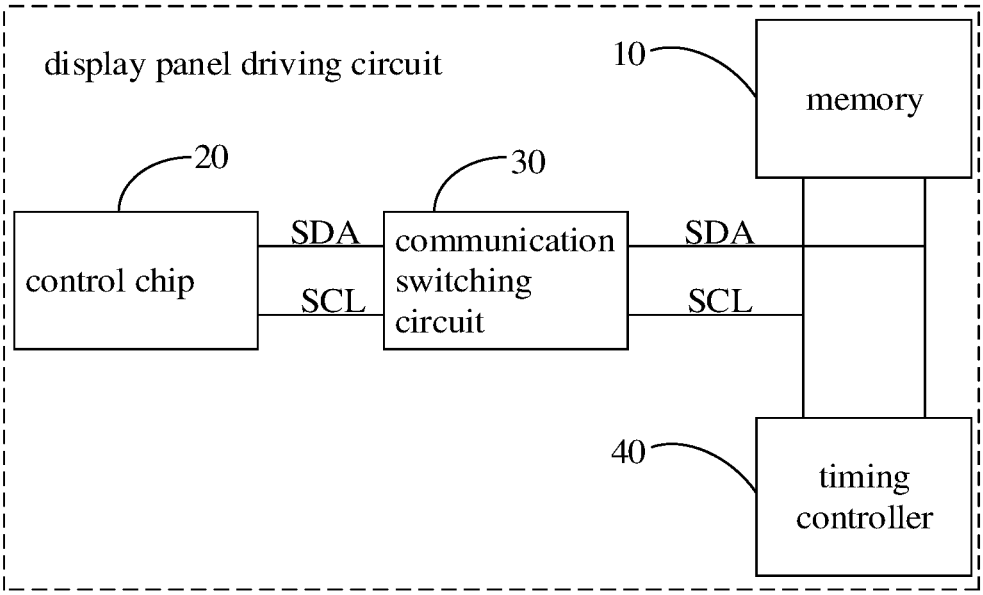
FIG. 1 is a functional block diagram of an embodiment of a display panel driving circuit of the present disclosure.
Figure 2:
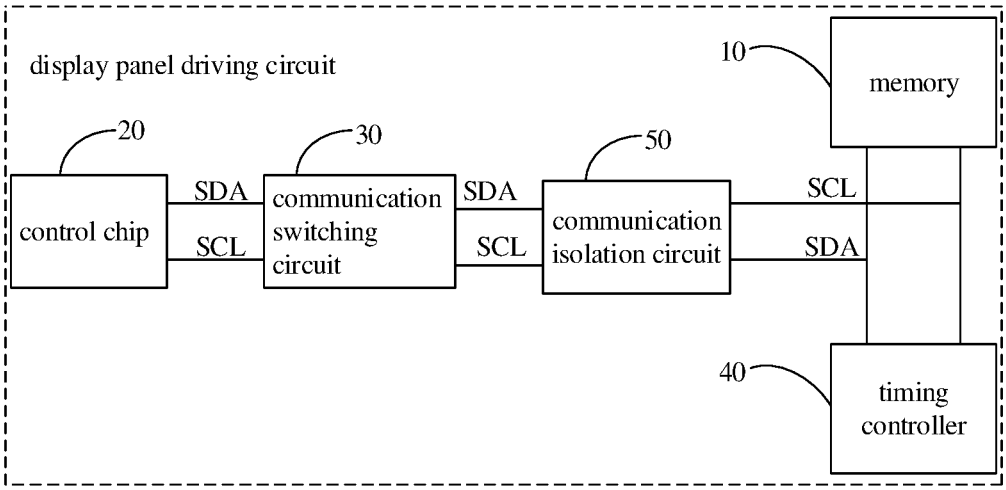
FIG. 2 is a functional block diagram of another embodiment of a display panel driving circuit of the present disclosure.
Figure 3:
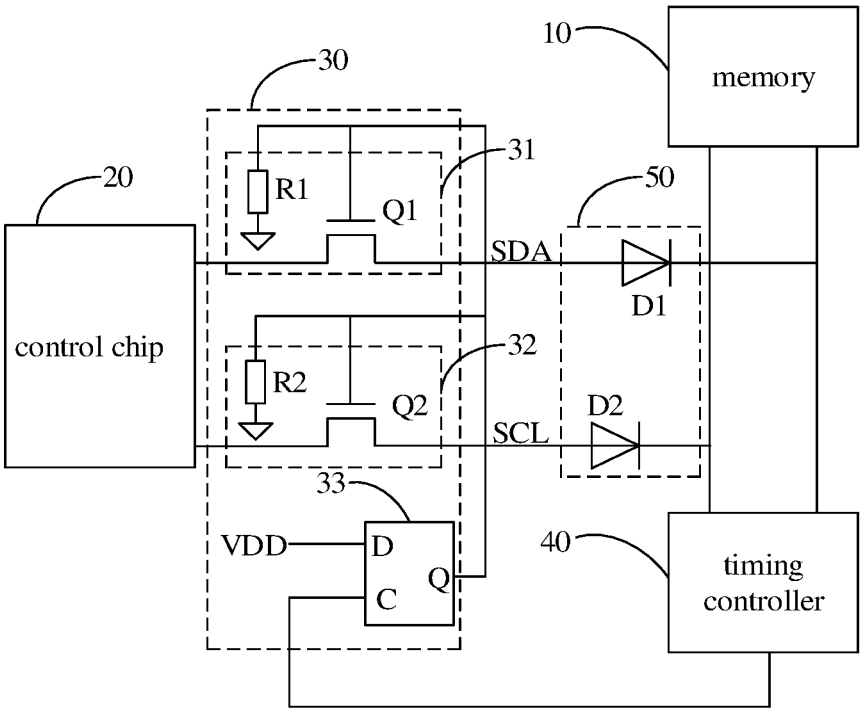
FIG. 3 is a schematic diagram illustrating a circuit structure of an embodiment of a display panel driving circuit of the present disclosure.

Referring to FIG. 1-FIG. 3, in an embodiment of the application, the display panel driving circuit includes:

a memory 10;

a control chip 20, connected to a serial communication bus;

a communication switching circuit 30, including a controlled end, a control signal input end and a control signal output end, the control signal input end is in communication with the control chip 20 through the serial communication bus; and a timing controller 40, including data transmission ends and a control end, the data transmission ends is connected with the control signal output end of the communication switching circuit 30 and a data output end of the memory 10, and the control end is connected with the controlled end of the communication switching circuit 30;

the timing controller 40 is configured to receive a control signal output by the control chip 20 when controlling the communication switching circuit 30 to be turned on and to read software data of the memory 10 when controlling the communication switching circuit 30 to be turned off.

In this embodiment, the display panel driving circuit further includes a gate driving circuit and a source driving circuit, and a controlled end of the gate driving circuit and a controlled end of the source driving circuit are both connected with an output end of the timing controller 40.

Both the memory 10 and the timing controller 40 may be arranged on a PCB of a Timing Controller (TCON), the memory 10 may store a control signal for driving the gate driving integrated circuit and the source driving integrated circuit to run and is in communication with the timing controller 40 via the serial communication bus, and when a display device is powered on and functions, the timing controller 40 reads the control signal in the memory 10 and other set data to perform an initial setting so as to generate a corresponding timing control signal to drive the source driving integrated circuit and the gate driving integrated circuit configured in a display panel in the display device to function. Data in the memory 10 is not modifiable when the display device functions normally, and once the data is modified, an error occurs in the set data, leading to an abnormal display of the display device. Therefore, in most cases, the memory 10 is provided with a Write Protection Pin (WP pin), when a high level is input, the memory 10 can be controlled to be written with data, and when a low level is input, no data can be written into the memory 10, and the memory 10 only allows the timing controller 40 to read data. The timing control board is also provided with a power processing circuit, and output ends of the power processing circuit are connected with the memory 10 and the timing controller 40 respectively. In the above embodiment, the serial communication bus may be an I2Cnter-Integrated Circuit communication bus, but other communication lines may be used, no restriction here.

The control chip 20 may be arranged on a main control board of the display device, and there may be one or more control chips 20, which may be set according to the function of the display device, and the control chip may be a main controller or video processing chip of the display device. When there are a plurality of control chips 20, each control chip 20 is connected with the timing controller 40 through the serial communication bus. The control chip 20 outputs an R/G/B compressed signal and the control signal to the timing controller 40 via the serial communication bus while the display device functions, and power passes through a power line and a power processing circuit. The power processing circuit converts the received power into a corresponding driving power supply and outputs the driving power supply to a circuit module on the timing control board. After the display device functions normally, the timing controller 40 converts the received R/G/B compressed signal and control signal into a data signal, a control signal and a clock signal suitable for the source driving circuit and the gate driving circuit in the display device to realize the image display of the display panel.

It should be noted that the control chip 20, the timing controller 40 and the memory 10 are all in communication through the serial communication bus, and the timing controller 40 needs to read the data of the memory 10 and the control chip 20 to realize the driving of the display panel. Therefore, during data reading of the timing controller 40, other chips may be affected. For example, when the timing controller 40 reads the data of the memory 10, the data of the memory 10 may run into the control chip 20, resulting in work disorder of the control chip 20, or when the timing controller 40 reads the data of the memory 10, the data signal of the control chip 20 is output to the timing controller 40 or the memory 10, causing the timing controller 40 to fail to read the data of the memory 10.

In order to solve the above problems, the display panel driving circuit of this embodiment may be provided with a communication switching circuit 30 to switch communication circuits. Specifically, the communication switching circuit 30 is turned on/off after receiving the control signal output by the timing controller 40. When the display device is powered on, the timing controller 40 controls the communication switching circuit 30 to be turned off; at this time, the timing controller 40 is in communication with the memory 10 through the serial communication bus to read the software data of the memory 10 and realize the initial setting of the timing controller 40. During this process, the communication switching circuit 30 is turned off, so the data of the control chip 20 will not be output to the memory 10 or the timing controller 40 via the serial communication bus, which will interfere with the reading of the data of the memory 10 by the timing controller 40, and at the same time, the data of the memory 10 will not run into the control chip 20, which will result in the dysfunction of the control chip 20. After initialization ends and the display device functions normally, the timing controller 40 controls the communication switching circuit 30 to be turned on; at this time, the timing controller 40 is in communication with the control chip 20 through the serial communication bus, so as to receive the control signal, the data signal and the clock signal output by the control chip 20, convert them into corresponding driving signals and then output them to complete the image display of the display panel.

According to the present disclosure, the control chip 20, the timing controller 40 and the memory 10 are arranged, communication is enabled through the serial communication bus, the communication switching circuit 30 is arranged in series between the control chip 20 and the timing controller 40, the communication switching circuit 30 is controlled by a timing control circuit, the communication between the timing controller 40 and the memory 10 is realized when the timing controller 40 controls the communication switching circuit 30 to be turned off, so that the timing controller 40 reads the software data of the memory 10, and then the initial setting of the timing controller 40 is completed. When the timing controller 40 controls the communication switching circuit 30 to be turned on, the communication between the timing controller 40 and the control chip 20 is realized, so that the control signal output by the control chip 20 is received, converted into a corresponding driving signal and then output to complete the image display of the display panel. The present disclosure solves the problem that when the timing controller 40 reads the data of the memory 10, the data of the memory 10 may run into the control chip 20, resulting in work disorder of the control chip 20, or the data signal of the control chip 20 is output to the timing controller 40 or the memory 10, causing the timing controller 40 to fail to read the data of the memory 10. The present disclosure effectively solves the problem of software reading errors of the timing controller 40 and improves the reliability of the display device.

Referring to FIG. 1-FIG. 3, in an alternative embodiment, the display panel driving circuit further includes a communication isolation circuit 50, the communication isolation circuit 50 is arranged in series between the communication switching circuit 30 and the timing controller 40, and the communication isolation circuit 50 is configured to isolate and then output the control signal output by the control chip 20 when the timing controller 40 controls the communication switching circuit 30 to be turned on.

It should be noted that parasitic capacitances and impedances are generally generated on the I2C bus of the memory 10 and the timing controller 40, these resistances and parasitic capacitances will generate electromagnetic interference after the display device is powered on, and these interference signals can easily reach the control chip 20 by running into the I2C bus when the control chip 20 is in communication with the timing controller 40. The communication isolation circuit 50 of this embodiment can conduct communication isolation on and then output the control signal output by the control chip 20 when the control chip 20 is in communication with the timing controller 40, so as to isolate the interference signals generated by the I2C bus of the memory 10 and the timing controller 40.

Further, in the above embodiment, the communication isolation circuit 50 includes a first unidirectional conduction element D1 and a second unidirectional conduction element D2, an input end of the first unidirectional conduction element D1 is connected with an output end of a first gating branch 31, and an output end of the first unidirectional conduction element D1 is connected with the second data transmission end of the timing controller 40;

and an input end of the second unidirectional conduction element D2 is connected with an output end of a second gating branch 32, and an output end of the second unidirectional conduction element D2 is connected with the second data transmission end of the timing controller 40. In this embodiment, the first unidirectional conduction element D1 and/or the second unidirectional conduction element D2 may be implemented as a unidirectional diode with the isolation characteristic such as optocoupler and diode, and optionally, a diode is adopted in this embodiment. With the unidirectional conduction characteristic, it is possible to avoid the problem that the data of the memory 10 runs into the control chip 20 when the timing controller 40 reads the data of the memory 10, causing work disorder of the control chip 20, so that the communication between the timing controller 40 and the memory chip may affect the normal functioning of other chips on the external I2C bus.

By means of the unidirectional conduction elements, this embodiment can also avoid the problem that when the communication gating circuit is turned on, that is, when the timing controller 40 receives the control signal of the control chip 20, the interference signals generated by the parasitic capacitances and impedances on the I2C bus connecting the memory 10 with the timing controller 40 run into the control chip 20, causing work disorder of the control chip 20, so that the communication between the timing controller 40 and the memory chip may affect the normal functioning of other chips on the external I2C bus.

Referring to FIG. 1-FIG. 3, in an alternative embodiment, the serial communication bus includes a data line SDA and a clock line SCL, the communication switching circuit 30 includes a first gating branch 31, a second gating branch 32 and a D flip-flop 33, a clock signal input end C of the D flip-flop 33 is connected with the control end of the timing controller 40, a data input end D of the D flip-flop 33 is connected with a first DC power supply VDD, a data output end Q of the D flip-flop 33 is connected with a controlled end of the first gating branch 31 and a controlled end of the second gating branch 32, the first gating branch 31 is arranged in series between the data line SDA and one data transmission end of the timing controller 40, and the second gating branch 32 is arranged in series between the clock line SCL and the other data transmission end of the timing controller 40. The first DC power supply VDD may be a power supply of the timing controller.

In this embodiment, the D flip-flop 33 is controlled by the timing controller 40 to assign a logic level of the data input end D, that is, the high-level first DC power supply VDD, to the data output end when receiving a rising edge trigger signal output by the timing controller 40, so that the data output end Q outputs a high-level control signal to the first gating branch 31 and the second gating branch 32, thereby controlling the first gating branch 31 and the second gating branch 32 to be turned on and realizing the communication between the control chip 20 and the timing controller 40. Upon receiving a falling edge trigger signal output by the timing controller 40, the D flip-flop 33 does not act, thereby controlling the first gating branch 31 and the second gating branch 32 to be disconnected, so as to disconnect the communication between the control chip 20 and the timing controller 40.

Referring to FIG. 1-FIG. 3, in an alternative embodiment, the first gating branch 31 includes a first electronic switch Q1 and a first resistor R1, a controlled end of the first electronic switch Q1 is the controlled end of the first gating branch 31 and is grounded through the first resistor R1, an input end of the first electronic switch Q1 is connected with the data line SDA, and an output end of the first electronic switch Q1 is connected with the second data transmission end of the timing controller.

The first electronic switch Q1, which may be implemented as a triode, an MOS tube and other switching tubes in the embodiment, is optionally implemented as an N-MOS tube in the embodiment. The first resistor R1 is a pull-down resistor and outputs a low-level control signal to a gate of the N-MOS tube so that the N-MOS tube is in an off state. When the display device is powered on, the timing controller 40 outputs the falling edge trigger signal, and the D flip-flop 33 does not act, thus keeping the N-MOS tube in the off state; at this time, the timing controller 40 is in communication with the memory 10 to realize the initial setting of the timing controller 40. After initialization ends and the display device functions normally, the timing controller 40 outputs the rising edge trigger signal to trigger the D flip-flop 33 to output a high-level control signal to control the N-MOS tube to conduct, and the timing controller 40 is in communication with the control chip 20 to complete the image display of the display panel.

Referring to FIG. 1-FIG. 3, in an alternative embodiment, the second gating branch 32 includes a second electronic switch Q2 and a second resistor R2, a controlled end of the second electronic switch Q2 is the controlled end of the second gating branch 32 and is grounded through the second resistor R2, an input end of the second electronic switch Q2 is connected with the data line SDA, and an output end of the second electronic switch Q2 is connected with the second data transmission end of the timing controller 40.

The second electronic switch Q2, which may be implemented as a triode, an MOS tube and other switching tubes in the embodiment, is optionally implemented as an N-MOS tube in the embodiment. The second resistor R2 is a pull-down resistor and outputs a low-level control signal to a gate of the N-MOS tube so that the N-MOS tube is in an off state. When the display device is powered on, the timing controller 40 outputs the falling edge trigger signal, and the D flip-flop 33 does not act, thus keeping the N-MOS tube in the off state; at this time, the timing controller 40 is in communication with the memory 10 to realize the initial setting of the timing controller 40. After initialization ends and the display device functions normally, the timing controller 40 outputs the rising edge trigger signal to trigger the D flip-flop 33 to output a high-level control signal to control the N-MOS tube to conduct, and the timing controller 40 is in communication with the control chip 20 to complete the image display of the display panel.

Referring to FIG. 1-FIG. 3, in an alternative embodiment, the display panel driving circuit further includes a third unidirectional conduction element (not shown), an input end of the third unidirectional conduction element is connected with the memory 10, and an output end of the third unidirectional conduction element is connected with the timing controller 40.

It should be noted that data in the memory 10 is not modifiable when the display device functions normally, and once the data is modified, an error occurs in the set data, leading to an abnormal display of the display device. Therefore, in most cases, the memory 10 is provided with a Write Protection Pin (WP pin), when a high level is input, the memory 10 can be controlled to be written with data, and when a low level is input, no data can be written into the memory 10, thereby performing write protection on the memory 100. The parasitic capacitances and impedances existing on the timing control board and the external serial communication bus easily lead to the generation of a noise train on the serial communication bus to a write-protect pin, a high level is thus caused, making the memory 10 enter a write-protect state; at this time, if the communication switching circuit 30 receives the control signal output by the timing controller 40 and is turned on, the control signal will enter the memory 10, causing the data of the memory 10 to be rewritten.

In order to solve the above problems, the third unidirectional conduction element may be implemented as a unidirectional diode with the isolation characteristic such as optocoupler and diode, and optionally, a diode is adopted in this embodiment. The third unidirectional conduction element prevents the data of the control chip 20 from running into the memory 10 when the timing controller 40 reads the data of the control chip 20, which may cause the data of the memory 10 to be rewritten.

The present disclosure further provides a display device, which includes a display panel and the display panel driving circuit as described above, a gate driving circuit and a source driving circuit of the display panel are both electrically connected with the display panel. A specific structure of the display panel driving circuit can be understood with reference to the foregoing embodiment and is not described here redundantly; it is to be appreciated that due to the use of the display panel driving circuit in the display device disclosed herein, embodiments of the display device disclosed herein include all the technical solutions of all the embodiments of the display panel driving circuit and achieve the same technical effects with the embodiments of the display panel driving circuit and are therefore not describe here redundantly.

In this embodiment, the display device may be a display device having a display panel such as a television, a tablet computer and a mobile phone.

The above mentioned is only the alternative embodiment of the present disclosure, which does not limit the patent scope of the present disclosure, and any equivalent structure transformation made by using the specification and the drawings of the application or direct/indirect applications in other related technical fields under the application concept of the present disclosure should be contained in the scope of patent protection.

What is claimed is:

1. A display panel driving circuit, wherein the display panel driving circuit comprises:

a memory;

a control chip, connected to a serial communication bus;

a communication switching circuit, comprising a controlled end, a control signal input end and a control signal output end, the control signal input end being in communication with the control chip through the serial communication bus; and a timing controller, comprising data transmission ends and a control end, the data transmission ends being connected with the control signal output end of the communication switching circuit and a data output end of the memory, and the control end being connected with the controlled end of the communication switching circuit; wherein the timing controller is configured to receive a control signal output by the control chip when controlling the communication switching circuit to be turned on and to read software data of the memory when controlling the communication switching circuit to be turned off.

2. The display panel driving circuit according to claim 1, wherein the display panel driving circuit further comprises a communication isolation circuit, the communication isolation circuit is arranged in series between the communication switching circuit and the timing controller, and the communication isolation circuit is configured to isolate and then output the control signal output by the control chip when the timing controller controls the communication switching circuit to be turned on.

3. The display panel driving circuit according to claim 2, wherein the communication isolation circuit comprises a first unidirectional conduction element and a second unidirectional conduction element, an input end of the first unidirectional conduction element is connected with an output end of a first gating branch, and an output end of the first unidirectional conduction element is connected with the data transmission end of the timing controller; and an input end of the second unidirectional conduction element is connected with an output end of a second gating branch, and an output end of the second unidirectional conduction element is connected with the data transmission end of the timing controller.

4. The display panel driving circuit according to claim 3, wherein the first unidirectional conduction element and/or the second unidirectional conduction element are diodes.

5. The display panel driving circuit according to claim 1, wherein the serial communication bus comprises a data line and a clock line, the communication switching circuit comprises a first gating branch, a second gating branch and a D flip-flop, a clock signal input end of the D flip-flop is connected with the control end of the timing controller, a data input end of the D flip-flop is connected with a first DC power supply, a data output end of the D flip-flop is connected with a controlled end of the first gating branch and a controlled end of the second gating branch, the first gating branch is arranged in series between the data line and one data transmission end of the timing controller, and the second gating branch is arranged in series between the clock line and the other data transmission end of the timing controller.

6. The display panel driving circuit according to claim 5, wherein the first gating branch comprises a first electronic switch and a first resistor, a controlled end of the first electronic switch is the controlled end of the first gating branch and is grounded through the first resistor, an input end of the first electronic switch is connected with the data line, and an output end of the first electronic switch is connected with the second data transmission end of the timing controller.

7. The display panel driving circuit according to claim 6, wherein the first electronic switch is a triode or MOS tube.

8. The display panel driving circuit according to claim 5, wherein the second gating branch comprises a second electronic switch and a second resistor, a controlled end of the second electronic switch is the controlled end of the second gating branch and is grounded through the second resistor, an input end of the second electronic switch is connected with the data line, and an output end of the second electronic switch is connected with the data transmission end of the timing controller.

9. The display panel driving circuit according to claim 8, wherein the second electronic switch is a triode or MOS tube.

10. The display panel driving circuit according to claim 1, wherein the display panel driving circuit further comprises a third unidirectional conduction element, an input end of the third unidirectional conduction element is connected with the memory, and an output end of the third unidirectional conduction element is connected with the timing controller.

11. The display panel driving circuit according to claim 1, wherein the display panel driving circuit further comprises a gate driving circuit and a source driving circuit, and a controlled end of the gate driving circuit and a controlled end of the source driving circuit are both connected with an output end of the timing controller.

12. A display panel driving circuit, wherein the display panel driving circuit comprises:

a memory;

a plurality of control chips, connected to a serial communication bus;

a communication switching circuit, comprising a controlled end, a control signal input end and a control signal output end, the control signal input end being in communication with the control chips through the serial communication bus;

a unidirectional conduction element, an input end of the unidirectional conduction element being connected with the control signal output end of the communication switching circuit; and a timing controller, comprising data transmission ends and a control end, the data transmission ends being connected with an output end of the unidirectional conduction element and a data output end of the memory, and the control end being connected with the controlled end of the communication switching circuit; wherein the timing controller is configured to receive a control signal output by the control chip when controlling the communication switching circuit to be turned on and to read software data of the memory when controlling the communication switching circuit to be turned off.

13. A display device, comprising a display panel and a display panel driving circuit, wherein a gate driving circuit and a source driving circuit of the display panel are both electrically connected with the display panel; and the display panel driving circuit comprises:

a memory;

a control chip, connected to a serial communication bus;

a communication switching circuit, comprising a controlled end, a control signal input end and a control signal output end, the control signal input end being in communication with the control chip through the serial communication bus; and a timing controller, comprising data transmission ends and a control end, the data transmission ends being connected with the control signal output end of the communication switching circuit and a data output end of the memory, and the control end being connected with the controlled end of the communication switching circuit; wherein the timing controller is configured to receive a control signal output by the control chip when controlling the communication switching circuit to be turned on and to read software data of the memory when controlling the communication switching circuit to be turned off.

14. The display device according to claim 13, wherein the display device further comprises a communication isolation circuit, the communication isolation circuit is arranged in series between the communication switching circuit and the timing controller, and the communication isolation circuit is configured to isolate and then output the control signal output by the control chip when the timing controller controls the communication switching circuit to be turned on.

15. The display device according to claim 14, wherein the communication isolation circuit comprises a first unidirectional conduction element and a second unidirectional conduction element, an input end of the first unidirectional conduction element is connected with an output end of a first gating branch, and an output end of the first unidirectional conduction element is connected with the data transmission end of the timing controller; and an input end of the second unidirectional conduction element is connected with an output end of a second gating branch, and an output end of the second unidirectional conduction element is connected with the data transmission end of the timing controller.

16. The display device according to claim 14, wherein the serial communication bus comprises a data line and a clock line, the communication switching circuit comprises a first gating branch, a second gating branch and a D flip-flop, a clock signal input end of the D flip-flop is connected with the control end of the timing controller, a data input end of the D flip-flop is connected with a first DC power supply, a data output end of the D flip-flop is connected with a controlled end of the first gating branch and a controlled end of the second gating branch, the first gating branch is arranged in series between the data line and one data transmission end of the timing controller, and the second gating branch is arranged in series between the clock line and the other data transmission end of the timing controller.

17. The display device according to claim 16, wherein the first gating branch comprises a first electronic switch and a first resistor, a controlled end of the first electronic switch is the controlled end of the first gating branch and is grounded through the first resistor, an input end of the first electronic switch is connected with the data line, and an output end of the first electronic switch is connected with the second data transmission end of the timing controller.

18. The display device according to claim 16, wherein the second gating branch comprises a second electronic switch and a second resistor, a controlled end of the second electronic switch is the controlled end of the second gating branch and is grounded through the second resistor, an input end of the second electronic switch is connected with the data line, and an output end of the second electronic switch is connected with the data transmission end of the timing controller.

19. The display device according to claim 13, wherein the display panel driving circuit further comprises a third unidirectional conduction element, an input end of the third unidirectional conduction element is connected with the memory, and an output end of the third unidirectional conduction element is connected with the timing controller.

20. The display device according to claim 13, wherein a controlled end of the gate driving circuit and a controlled end of the source driving circuit are both connected with an output end of the timing controller.

* * * * *